US009190042B2

(12) United States Patent
Plott et al.

(10) Patent No.: US 9,190,042 B2
(45) Date of Patent: Nov. 17, 2015

(54) SYSTEMS AND METHODS FOR MUSICAL SONIFICATION AND VISUALIZATION OF DATA

(71) Applicant: CALIFORNIA INSTITUTE OF TECHNOLOGY, Pasadena, CA (US)

(72) Inventors: Charles R. Plott, Pasadena, CA (US); Max J. Hirschhorn, Pasadena, CA (US); Hsingyang Lee, Arcadia, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 0 days.

(21) Appl. No.: 14/607,001

(22) Filed: Jan. 27, 2015

(65) Prior Publication Data

US 2015/0213789 A1 Jul. 30, 2015

Related U.S. Application Data

(60) Provisional application No. 61/932,018, filed on Jan. 27, 2014.

(51) Int. Cl.
*G10H 1/18* (2006.01)
*G10H 1/00* (2006.01)

(52) U.S. Cl.
CPC ..... *G10H 1/18* (2013.01); *G10H 1/0066* (2013.01); *G10H 2220/155* (2013.01)

(58) Field of Classification Search
USPC ..... 84/600, 609
IPC ..... G10H 1/18
See application file for complete search history.

(56) References Cited

U.S. PATENT DOCUMENTS

| | | | | |
|---|---|---|---|---|
| 5,371,854 | A * | 12/1994 | Kramer | 704/270 |
| 5,730,140 | A * | 3/1998 | Fitch | 600/514 |
| 8,475,385 | B2 * | 7/2013 | Watson | 600/485 |
| 2005/0115381 | A1 * | 6/2005 | Bryden et al. | 84/600 |
| 2005/0240396 | A1 * | 10/2005 | Childs et al. | 704/207 |
| 2008/0204458 | A1 * | 8/2008 | Catravas | 345/474 |
| 2009/0231346 | A1 * | 9/2009 | Elkins et al. | 345/473 |
| 2010/0318512 | A1 * | 12/2010 | Ludwig | 707/722 |
| 2011/0308376 | A1 * | 12/2011 | Ludwig | 84/604 |
| 2014/0074479 | A1 * | 3/2014 | Kassam et al. | 704/270 |

OTHER PUBLICATIONS

Zhang , S. "NASA Scans Through Vast Amounts of Data by Converting It to Sound" Gizmodo. (Sep. 4, 2014) Accessed: Jan. 27, 2015. http://gizmodo.com/nasa-scans-through-vast-amounts-of-data-by-converting-i-1630766384.

"Sonification" Wikipedia—Accessed via WayBackMachine.com, Dec. 29, 2014 Accessed: Jan. 27, 2015 https://web.archive.org/web/20141229153008/http://en.wikipedia.org/wiki/Sonification.

(Continued)

*Primary Examiner* — David Warren
(74) *Attorney, Agent, or Firm* — Steinfl & Bruno LLP

(57) ABSTRACT

The current disclosure is directed to systems and methods for automatically converting multi-dimensional, complex data sets to musical symbols while representing the converted data in an animated graph. The system groups the data into a number of subsets of data according to a set of user-configured rules and maps the grouped data points to musical notes according to configurable mapping parameters.

17 Claims, 8 Drawing Sheets

(56) References Cited

OTHER PUBLICATIONS

Hemsley J. "Data sonification with R: the sound of Twitter data" R-Bloggers. (May 29, 2013) Accessed: Jan. 27, 2015 http://www.r-bloggers.com/data-sonification-with-r-the-sound-of-twitter-data/.

Prince A. "Particle Pings: Sounds of the Large Hadron Collider" NPR. (Jan. 2, 2011) Accessed: Jan. 27, 2015 http://www.npr.org/2011/01/02/132415764/particle-pings-sounds-of-the-large-hadron-collider.

Ilitch, V. Saturn II The complet collection of the Planets sounds records , Nasa Voyager . (Jul. 17, 2011) Accessed: Jan. 27, 2015 https://www.youtube.com/watch?v=xW6zzzXXwPU.

Patel, K. "More Than Meets the Eye: NASA Scientists Listen to Data" NASA. (Sep. 4, 2014) Accessed: Jan. 27, 2015 http://www.nasa.gov/content/goddard/more-than-meets-the-eye-nasa-scientists-listen-to-data/#.VMf_22jF_pR.

* cited by examiner

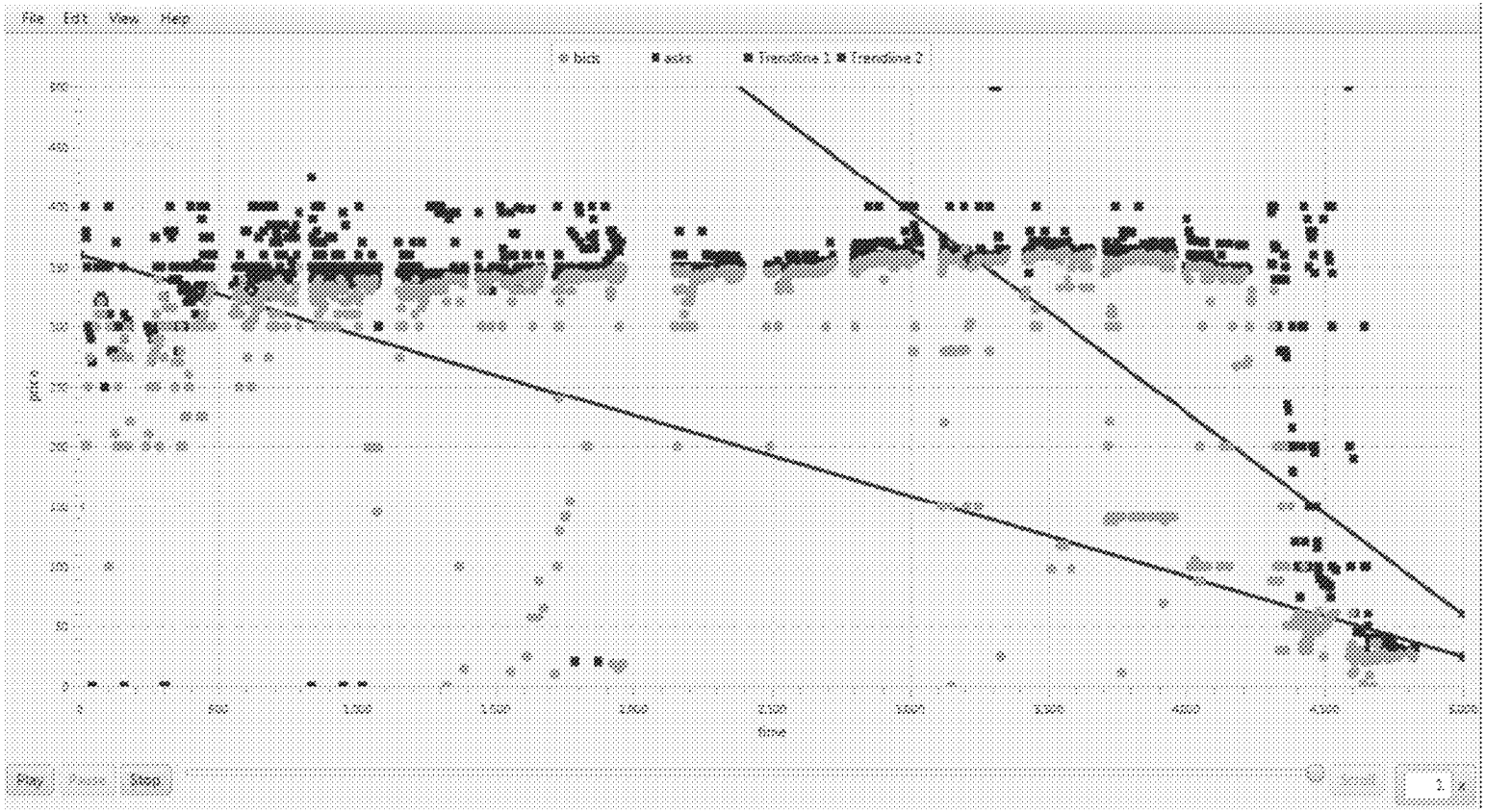
File Edit View Help
bias
sales
Transform 1
Transform 2
20
40
60
80
100
120
140
160
180
200
220
240
260
280
300
320
340
360
380
400
420
440
460
480
500
520
540
560
580
600
620
640
660
680
700
720
740
760
780
800

SYSTEMS AND METHODS FOR MUSICAL SONIFICATION AND VISUALIZATION OF DATA

CROSS-REFERENCE TO RELATED APPLICATION

The present application claims priority to U.S. Provisional Application No. 61/932,018, entitled "A Mechanism for Representing Data in the Form of Sound and Graphics" filed on Jan. 27, 2014, the disclosure of which is incorporated by reference in its entirety.

TECHNICAL FIELD

The current disclosure is directed to data presentation, and in particular, to methods and systems for musical sonification and visualization of multi-dimensional, complex data sets.

BACKGROUND

Computers with visual displays are commonly used to process and/or monitor complex numerical data sets and to produce graphs from live data feeds in real-time. However, visual displays are often overused in complex, data-intensive situations, and might fail to discover hidden patterns in such situations. For example, in financial industry, a trader must constantly view multiple screens displaying multiple different graphical representations of real-time market data for different markets.

Human ears provide a very good alternative and supplementation to the visual way of reception information for visualization and understanding complex data sets. Data sonification can effectively display large and multi-dimensional data sets which can help in uncovering otherwise hidden correlations and patterns. It can also be used in presentations to an audience so that they can quickly understand the implications of patterns in data they are introduced to for the first time. It can also provide way of presenting data that is more entertaining than just showing the data graphically.

Accordingly, there is a need for a sonification system, in particular, a musical sonification system that complements visualization and provides users with alternative and additional ways of identifying and extracting physical signatures represented in the data. In particular, there is a need for a musical sonification and visualization system and method that is capable of improving visual perception when accompanied by audio signals and data exploration of large multi-dimensional data sets.

SUMMARY

In a first aspect of the disclosure, a method for musical sonification and visualization of data is described, the method comprising: receiving grouping rules; receiving mapping parameters; receiving at least one set of data comprising data rows, each of said data rows comprising a plurality of data entries; grouping the data rows into a plurality of groups according to the grouping rules; mapping the grouped data rows to audible symbols and graphical symbols according to the mapping parameters, such that each group of the plurality of groups has a corresponding one of the audible symbols and a corresponding one of the graphical symbols; rendering the audible symbols to an audio output; and rendering the graphical symbols to a visual output.

In a second aspect of the disclosure, a musical sonification and visualization system is described, comprising: one or more processors; one or more data-storage devices; and computer instructions stored in one or more of the one or more data-storage devices that when executed by one or more of the one or more processors, control the musical sonification and visualization system to receive grouping rules; receive mapping parameters; receive at least one set of data comprising data rows, each of said data rows comprising a plurality of data entries; group the data rows into a plurality of groups according to the grouping rules; map the grouped data rows to audible symbols and graphical symbols according to the mapping parameters, such that each group of the plurality of groups has a corresponding one of the audible symbols and a corresponding one of the graphical symbols; render the audible symbols to an audio output; and render the graphical symbols to a visual output.

The details of one or more embodiments of the disclosure are set forth in the accompanying drawings and the description below. Other features, objects, and advantages will be apparent from the description and drawings, and from the claims.

BRIEF DESCRIPTION OF THE DRAWINGS

FIGS. 3A-3E show various displays of a graphic user interface of the sonification and visualization system.

DETAILED DESCRIPTION

The current document is directed to systems and methods for producing musical and graphic renderings of sets of data by mapping the data to both sound to be played and symbols to be displayed at x, y coordinates, and playing back the rendered sound to a user while displaying the symbols on a graph. In a first subsection, computer architecture is introduced. In a second subsection, a system and method for musical sonification and visualization of a data stream is described. In a third subsection, one embodiment of data sonification and visualization in graphical user interface is provided.

DEFINITIONS

As used herein, the following definitions apply when referring to data:

Data set: the total data undergoing sonification

Column: a division of the data set that represents a certain category of data (example: time, actions, bid, price and sid); also known as a "field"

Entry: a value in the data set

Row: a list of related entries corresponding to values for each column

Group: a data series consisting of a subset of rows from the data set (groups can be overlapping: a row can be in more than one group). A group can be thought of as a data series.

As used herein, the term "output modeling" refers to configuring either the audio or graphical output based on rules applied to an entry to be output to a user. For audio output, this can refer to, for example, pitch, instrument type, volume, or sound duration. For graphical output, this can refer to, for example, color, size, tint, shape, or added graphical effects, such as shadows, halos, or outlines, of the graphical symbols used to show where each data point is located on the x, y coordinate system.

Computer Architecture

Figure 1:
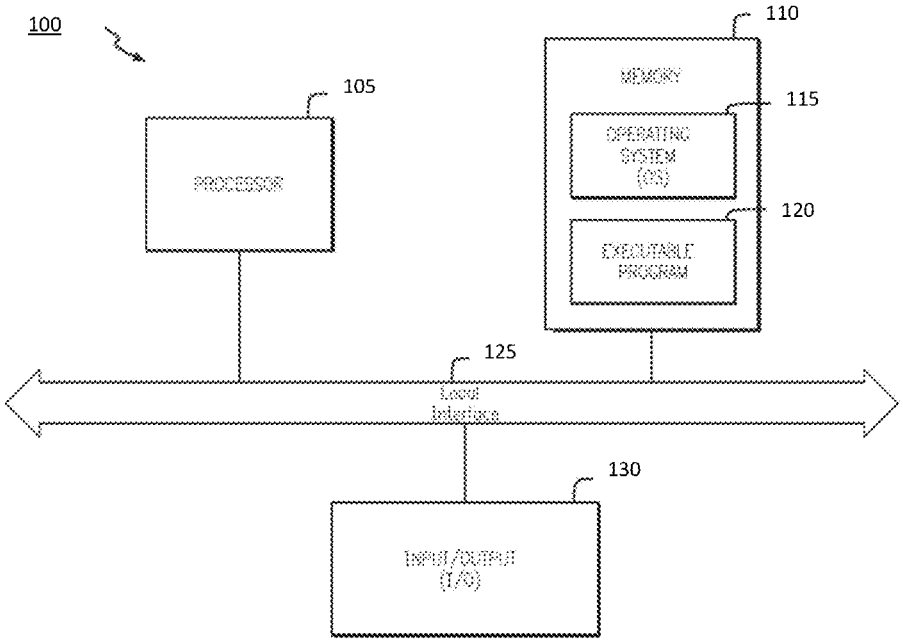
FIG. 1 is an exemplary embodiment of a computer system for implementing the embodiments of the present disclosure.

FIG. 1 is an exemplary embodiment of a target hardware (100) (e.g., a computer system) for implementing the embodiments of the present disclosure. This target hardware comprises a processor (105), a memory bank (110), a local interface bus (125) and one or more Input/Output devices (130). The processor can execute one or more instructions related to the implementation of the current disclosure, and as provided by the Operating System (115) based on some executable program (120) stored in the memory (110). These instructions are carried to the processor (105) via the local interface (125) and as dictated by some data interface protocol specific to the local interface and the processor (105). It should be noted that the local interface (125) is a symbolic representation of several elements such as controllers, buffers (caches), drivers, repeaters and receivers that are generally directed at providing address, control, and/or data connections between multiple elements of a processor based system. In some embodiments the processor (105) can be fitted with some local memory (cache) where it can store some of the instructions to be performed for some added execution speed. Execution of the instructions by the processor can require usage of some input/output device (130), such as inputting data from a file stored on a hard disk, inputting commands from a keyboard, inputting data and/or commands from a touchscreen, outputting data to a display, or outputting data to a USB flash drive. In some embodiments, the operating system (115) facilitates these tasks by being the central element to gathering the various data and instructions required for the execution of the program and provide these to the microprocessor. In some embodiments the operating system is missing, and all the tasks are under direct control of the processor (105), although the basic architecture of the target hardware device (100) will remain the same as depicted in FIG. 1. In some embodiments a plurality of processors can be used in a parallel configuration for added execution speed. In such a case, the executable program can be specifically tailored to a parallel execution. Also, in some embodiments the processor (105) can execute part of the implementation of FIG. 1 et al., and some other part can be implemented using dedicated hardware/firmware placed at an Input/Output location accessible by the target hardware (100) via local interface (125). The target hardware (100) can include a plurality of executable programs (120), wherein each can run independently or in combination with one another.

A System and Method for Sonification and Visualization of Multi-Dimensional Data The currently disclosed sonification and visualization system provides a mechanism for representing multi-dimensional, complex data sets in the forms of sound and graphics. In particular, the sonification system supports auditory mapping of data to sound in a musical way.

The term sonification is commonly referred to as the use of non-speech audio to convey information. More specifically, sonification is the transformation of data relations into perceived relations in an acoustic signal for the purposes of facilitating data interpretation or communication. Musical sonification is a type of sonification that maps data to sound in a musical way. For example, complex data sets can be converted to one or more instrument types of sound, such as to create orchestra music pieces. Properly configured, the right set of data can even be represented as a familiar tune or refrain. The data could also be presented in way that emphasizes the pattern and impact of the underlying processes that produced the data.

Figure 2:
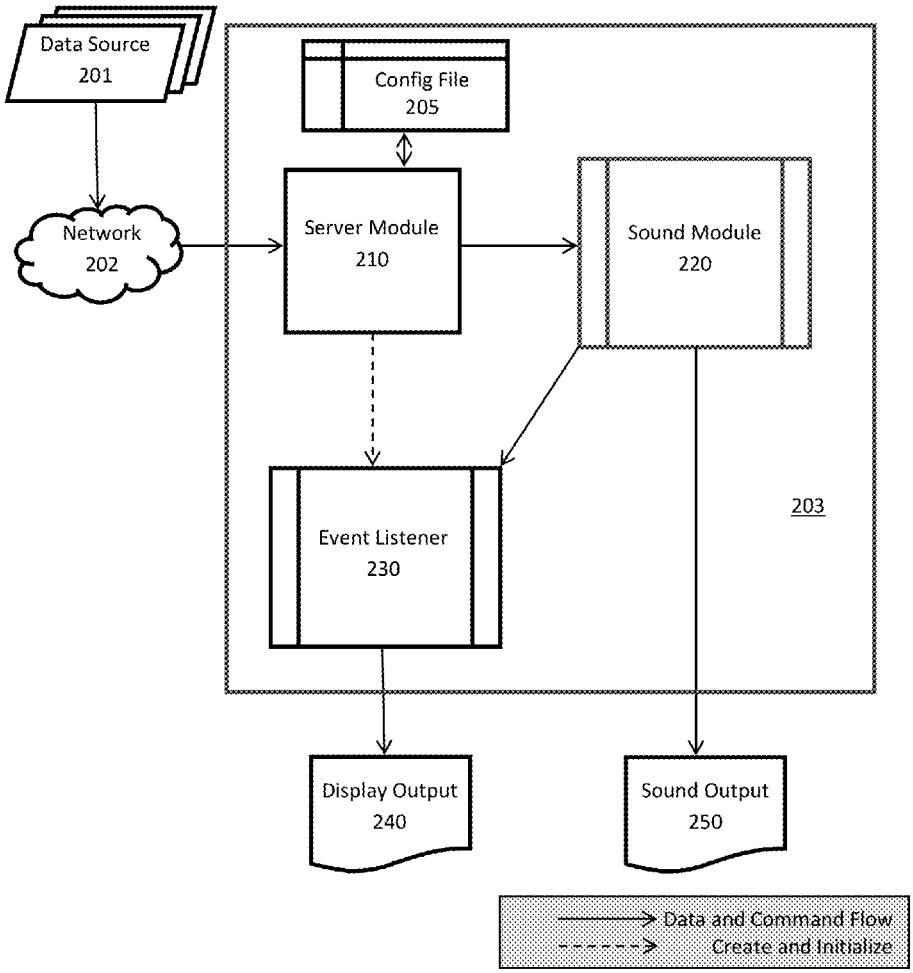
FIG. 2 shows a functional block diagram of one embodiment of the system and method for sonification and visualization of a data stream.

FIG. 2 shows a functional block diagram of one embodiment of the system and method for sonification and visualization of a data stream.

Data Stream

In general, the system 203 receives a data stream from a data source 201, typically over a network 202, and passes data input values from the data stream to a server module 210. The data stream can support one or more private and/or public data source 201, including real-time data series. Undefined data sources 201 can also be supported by providing user-generated data input in formats acceptable to the system 203.

The presently disclosed system and method for musical sonification of data are not restricted to a particular type of data, but are generally applicable to a wide variety of different types of data.

In some embodiments, the data stream support data in the financial trading industry. For example, the data stream can include industry-standard market data feeds from leading providers of equity securities or other financial data.

Other types of data that can be musically sonified include, but are not limited to, scientific data, traffic data, security data, and weather data. Any data that can be represented on an x-y graph can be musically sonified.

In some embodiments, the outflow from the execution of data acquisition of the streamed data is a description of one or more specific data inputs in a table format. The functionality provided by the current version of the system accepts the input data in CSV (comma-separated values) format, but such functionality can be extended to accept TSVs (tab-separated values) or other flat file format as well.

Server Module

The server module 201 maps data points to MIDI notes based on user specified rules. The user specified rules can be saved in one or more configuration data file 205, which can be created and edited manually or using a graphic user interface (GUI). The configuration data file 205 generally includes information related to the data being converted, such as filtering rules, user-defined thresholds, data ranges, as well as sound parameters that correspond to sound characteristics, including instrument type, pitch, volume, time duration and other effects. The configuration data also include information related to the graphic rendering of the data, including plotting properties such as data ranges for the x and y axis and colors and shapes of the symbols representing the data points. By specifying the parameters stored in the configuration data 205, the user can establish appropriate musical and graphic rendering of the data by setting individualized preferences.

The sonification system 203 can filter the incoming data according to a set of user-defined rules. Such a filtering feature can be used to play only a particular subset of the input data, referred to as a "group." The system 203 can also change the output modelling of a given group to differentiate that group from the rest of the data set. The sonification, therefore, can be used to highlight certain actions over others. For example, in the financial industry, the filtering feature can be used to highlight bids placed by a particular person or that occurred during a certain time range (for example, at the end of a day) by altering the audio and/or graphical output for data, related to that particular person or time range, to be sent to the display output 240 and/or the sound output 250 respectively. Since groups can be overlapping, a single data point can be represented by multiple sounds being played at the same time. For example, a particular bid submitted by a particular source might produce one sound representing that the entry is a "bid" and another sound representing the source of that bid. As another example, when multiple groups "bids", "asks" and "offers" are defined and used, in which group "offers" contains entries from groups "bids" and "asks", the entries contained in group "offers" can produce a series of sounds of one instrument, such as piano notes, while entries contained in groups "bids" and "asks" may produce sounds of other instruments such as, drum and bell, respectively, at flat pitch. Likewise, for the visualization of the data, the groups can be used to differentiate the graphical output modelling for each group. Grouping can also be used to represent particular types of events that together carry information. For example, a chord can result when a system of markets equilibrate or are near a simultaneous equilibrium.

The server module 210 can also encapsulate commands in the MIDI data series for graphing and other functions. The server module 210 maps each data point to a corresponding x, y coordinate according to the x- and y-axis specified in the configuration data file 205. For example, the x coordinate (horizontal) might correspond to values in the "time" field, and the y coordinate (vertical) might represent values in the "ask", "bid", "close", etc. groups depending on what the "action" entry for a given row indicates. For each data point, an additional message is also encoded into the MIDI stream with the x, y coordinate to be plotted on the graph using graphical symbols (e.g., squares, circles, triangles), along with the group names shown in relation to their corresponding graphical symbol. The user is able to save the configuration of the application program, which includes the sound and visual characteristics, as well as different data groups. Therefore, when the user imports the newly generated CSV into the program, the program state is reloaded and any further parameterization can be carried out as needed.

The server module can pass the generated MIDI data series to the sound module 220 for further processing and creates an event listener 230 process to respond to callback event when midi notes are played by midi sequencer.

The server functions can provide controls for MIDI sequencer playback through the sound module 220.

The server module can save playback profiles in local files so that the profiles can be played back for repeated operations.

Sound Module

The sound module 220 sonifies the mapped data to produce an audio signal for the sound output 250. The sound module 220 includes functions that synthesize and play the mapped musical notes using, for example, the Java Sound library. Some embodiments of the sound module 220 use a MIDI sound module 220 or a MIDI synthesizer to generate the audio output signal or play music in response to the generated MIDI data. Although some embodiments of the current disclosure are implemented using the Java programming language, many other conventional computer programming languages can be used, including C++. The sonification scheme can be implemented in any programming language that can appeal to the use of a sound library.

In some embodiments, to generate sound sequences, the program starts up the MIDI system, which provides a soundbank and synthesizer to produce the instrumental sounds. Other types of sound synthesis software can also be used. For example, when a user presses "play" from a dropdown menu, each data group is buffered in a separate track by its own thread. If an entry in the input data matches a particular group, then a MIDI event is created for such a data entry by adding a NOTE_ON message, and then shortly thereafter a NOTE_OFF message, to the track. The NOTE_ON message indicates when the note should start to play and the NOTE_OFF message indicates when the note should stop playing during playback of the sonification.

In addition, the sound module 220 also generates one or more events for the event listener 230 module to receive and respond. The event data generated for the event listener 230 include the series name and the x, y coordinates, which are used for updating the visualization. Commands can be encapsulated to control the playback and/or the graphical output during a presenter mode. For example, a presenter can schedule an event that causes the playback to pause at a particular time during the course of the animation. Such a feature would allow the presenter to summarize recent events without manual intervention with the program. As another example, a tempo factor can be scheduled to increase after a certain point during the animation. Likewise, the graphical output can be manipulated by generated events as well, such as displaying trendlines, captions, or shapes that overlay on the chart view. The generated events can also be saved as part of the configuration data.

Event Listener Module

The program also sets up an event listener 230 module to catch messages encoded in the MIDI stream. In response to the input event data passed from the sound module 220, the event listener 230 plots graphs for the display output 240 based on the x, y coordinates using, for example, the JavaFX™ library. Alternatively, other graphics and media packages can also be used. The event listener 230 also performs other functions that can be commanded in the event data.

Data Sonification and Visualization in Graphical User Interface

A user can initialize the application program by loading one or more pre-existing configuration data files 205 into the program. The pre-existing configuration files 205 can be saved in XML format or other appropriate formats acceptable by the application program. Alternatively, the user can load a CSV file containing a set of sample data and use the GUI to configure the parameterization settings.

Figure 3A:
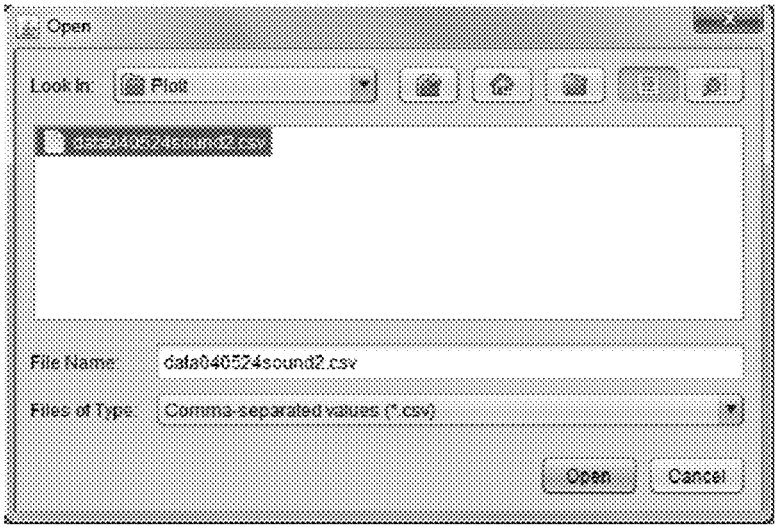
Figure 3B:
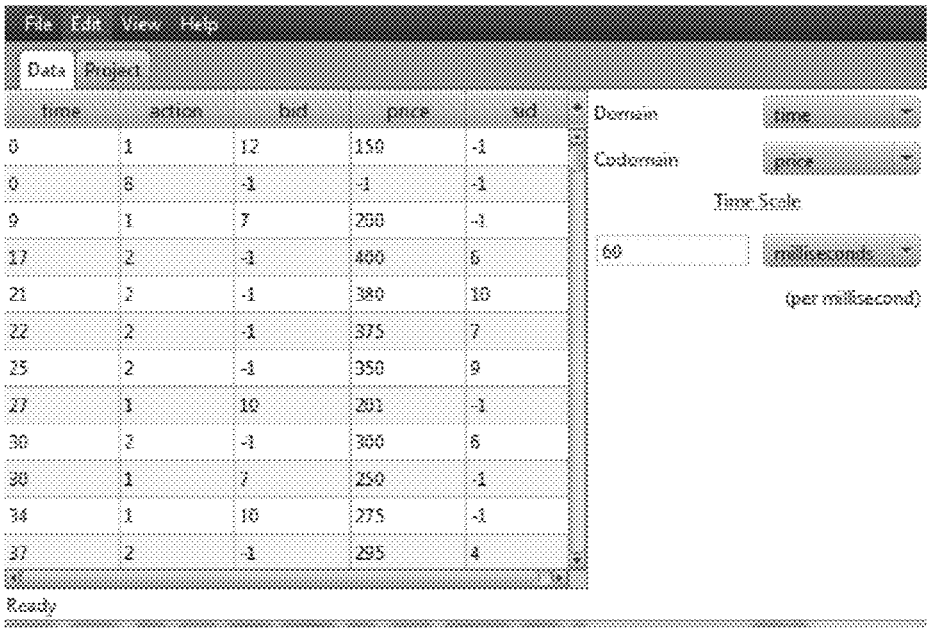

To load a sample CSV file, a user can choose the file by opening a dialog window from the drop-down menu. For example, a file with a "csv" extension can be selected from the dialog-window shown in FIG. 3A. The main content of a raw input data file, such as the data040524sound2.csv file selected in FIG. 3A, includes a number of rows and columns. A row is equivalent to a data record containing fields, with the value of each field corresponding to value stored in each cell of the table. The left section of FIG. 3B illustrates the main content of the CSV file after being read into the application system. A data record shown in FIG. 3B contains five columns corresponding to five different fields: time, action, BID, price, and SID. BID and SID represent the identification numbers of buyers and sellers, respectively. For example, the values "7" and "10" in the SID column represent two different sellers and the values "7" and "10" in the BID column represent two different buyers. The value "−1" in both the BID and SID columns represents an accounting action by the market tracking system.

The raw input data file data040524sound2.csv can begin with a mapping section that includes mappings specified as having equality to a particular value for one or more fields, each to a unique group. In the example shown below, the mapping is specified for the action field. The mapping shown below reflects the correspondence between the values in the action field and the different groups named "bids", "asks", "take-bids", and "take-asks". Within the data set, the action field indicates which group or groups the given row is placed in for filtering and output modeling purposes. For example, when the action field contains the value "1", the row containing the value 1 in the action field is placed in the "bids" group. Similarly, when the action field contains the value "3", the corresponding row is placed in the "take-bids" group. If the same value for the action field is filtered on by multiple groups, then those rows may be placed into multiple groups, and are therefore subject to multiple filtering/output rules. The beginning of the data set can include the definitions of the various "action" values, as shown in an example below.

@action 1: bid
@action 2: ask
@action 3: take-bid
@action 4: take-ask

The application program parses these mappings to auto-generate a filter, referred to as a data group, which can be used to play only a particular subset of the input data. Using the example shown above, four data groups named "bid", "ask", "take-bid", and "take-ask" are generated, each group representing a set of rows that contain a specified value in the action field. Therefore, each data group represents a subset of the entire dataset contained in a data table. A data group is defined in terms of a function that outputs true or false, based on whether the data should be included or excluded from the data group, respectively. The user can create a compound groups by building up combinations of Boolean expressions, using Boolean operators (AND, OR, NOT) and comparison operators (>, <, =), over the different fields of the data set. For example, a user can define a new group called "offers" that corresponds to the Boolean logic "(action=1) OR (action=2)", where (action=1) corresponds to the "bids" group and (action=2) corresponds to the "asks" group described above. In this way, "offers" can be treated as a series that contains both bids and asks, and can be played with its own set of parameters (price-to-note mapping and graphical characteristics). Therefore, a bid shared by the "bids" and "offers" groups can be played under two different sets of parameters, each corresponding to the price-to-note mapping and graphical characteristics defined for that group. Alternatively, a group can be filtered down by using the value of another field. For example, a user can create a new group named "large-bids" by defining the Boolean logic "(action=1) AND (price>500)". The "large-bids" group corresponds to a subset of the "bids" group in which the price field of the entries has a value greater than "500".

Following the mapping section, the raw input data file includes a header for the respective column names and types, for example, integer <int>, floating-point <float>, or string <str>. The exemplary header shown below indicates five columns, each represented by an integer-type:

#<int>, <int>, <int>, <int>, <int>
time, action, bid, price, sid

On the right section of the display shown in FIG. 3B, the user can select the "Domain" and "Codomain" from dropdown menus, each corresponding to the x- and y-axis, respectively. The dropdown menus for "Domain" and "Codomain" contain a list of column names for the dataset shown in the data table. In the example shown in FIG. 3B, "time" is selected for the "Domain" axis and "price" for the "Codomain" axis.

It should be noted that although the time evolution of one dimension of data is used as one example, which can be graphically represented as a line, the program can be extended to include functionalities to support the representation of multiple dimensions of data. For example, a time evolution of two dimensions of data can be graphically represented in a grid.

Figure 3C:
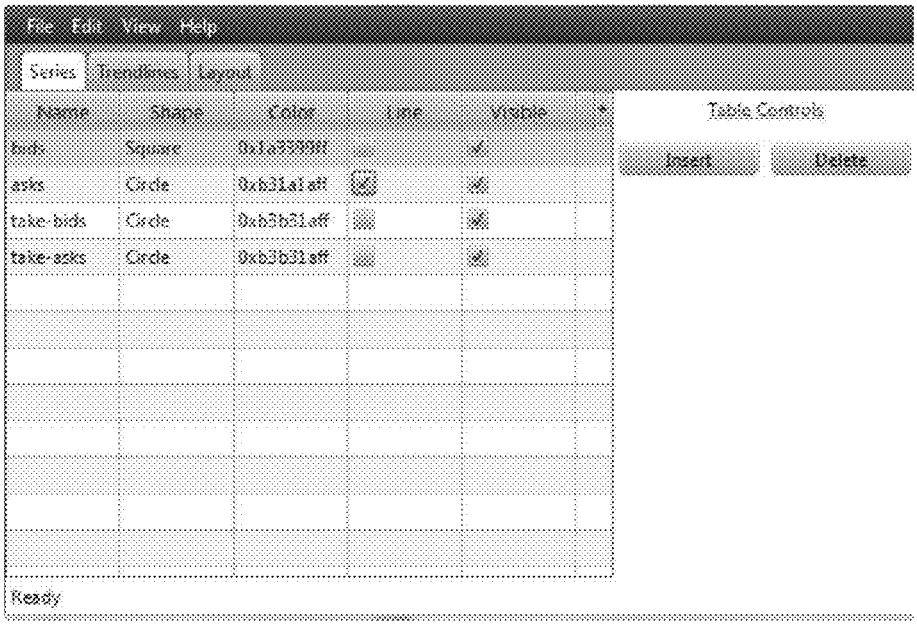

With respect to the graph properties, the user can customize the look of a particular group by means of multiple dropdown selections provided in the program. For example, as shown in FIG. 3C, the user can set the shape and color of the data markers on the graph, as well as whether the points should be connected by a line. Each data group can be parameterized (audio output modeling) separately. For example, the user can have the data point in the "bid" group colored as blue squares with no connecting line and the data points in the "ask" group colored as red circle and connected with a purple line. Users can also generate trendlines by inputting endpoint coordinates relative to the x and y scale and the range of the dataset. The program then displays the trendlines when the range is in scope of the current visible window.

Figure 3D:
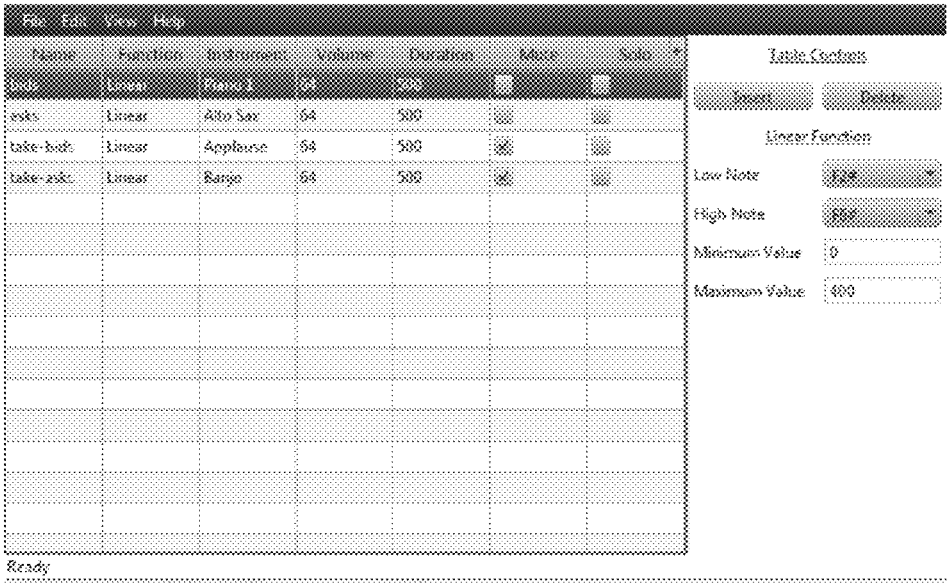

With respect to the sound properties, the user can customize the sound of a particular group by means of multiple dropdown selections. For example, as shown in FIG. 3D, the user can set the instrument, volume, and duration of the notes for each group.

The instrument types include, but are not limited to, acoustic instruments such as piano, harp, violin, banjo, saxophone, as well as synthesized sound types such as "applause". Different sound types can be selected to distinguish between different data streams (groups) so that certain types of data (different groups) are associated with certain types of sound, thereby allowing the recognition of multiple types of data at the same time. Each type of sound (instrument) can be referred to as an "audible symbol".

In some embodiments, the volume column contains volume multipliers of the row datum. When played, the note corresponding to this datum will be played <v> times louder than the minimum volume, where <v> is the value in the cell. The duration column contains duration multiplier of the row datum. When played, the note corresponding to this datum will be played <d> times longer than the minimum duration, where <d> is the value in the cell.

In some embodiments, the volume column contains a particular volume within a range of a MIDI system. In the example shown in FIG. 3D, the <v> is 64 corresponding to a moderate volume "64" in the range of a MIDI system from 0 (the softest) to 127 (the loudest). The <d> value of 500 corresponds to a particular duration of time the note is held in milliseconds (i.e. half a second).

The user can also define a parameterization function for the y-axis values and specify the minimum and maximum data values and the lowest and highest MIDI notes on the right section of FIG. 3D. In this example, the lowest note indicates the note to play for the lowest value; the highest note indicates the note to play for the highest value; the lowest value indicates the minimum threshold of a datum's y-value (i.e. value on the "Codomain" axis) to be played; and the highest value indicates the maximum threshold of a datum's y-value to be played. The exclusion of data above and/or below certain threshold values allows the program to filter out outlier data in the sonification, while still allowing the outliers to be visualized. The program also supports mute/solo options for different data series, thereby allowing filtering of the data for the audio output independently of the filtering of data for the graphical output.

The program then takes these four values and constructs a linear mapping of data value to MIDI note. To do so, the program creates a bin (i.e. a range of data) for each MIDI note that partitions the y-axis space. So when the function receives a data value that falls in a particular bin, a MIDI note is returned. By default, the program constructs a linear scaling function for parameterization using these four values, but any monotonic functions can be used. For example, a logarithmic scaling can be selected as a parameterization function to yield a larger pitch differential for smaller data values that are still close together, but a smaller pitch differential for larger data values that are farther apart. In such a case, the size of the bin increases exponentially as the data values grow. Each data group can be parameterized separately so that it is possible to specify different ranges of notes or different ranges of values or even different scaling functions for different groups. Such features enable the user to highlight different sections of the data.

To generate a graphic and musical rendering of the input data, the user selects the graph animation option from the dropdown menus. A new window (FIG. 3E) then pops-up with an animated graph (e.g., displaying the data on the graph in a piece-wise fashion) showing data points being plotted, as well as playing the audible symbols corresponding to those data points as they are displayed (e.g., playing the sounds in sync with the animation, so that when a data point is displayed on the graph, the corresponding sound plays). Different graph animation can be created based on the user input and parameterization settings. The program can also support play/pause options and can adjust the speed of playback.

Using the combination of audio and visual displays, new patterns or phenomena that using a visual display alone might miss can be identified. The musical sonification methods can allow for improving perception bandwidth when accompanied by audio signals and the possibility to monitor data while looking at multiple screens or while looking away from the visual display of the data.

One Embodiment of the Data Sonification and Visualization System

Figure 4:
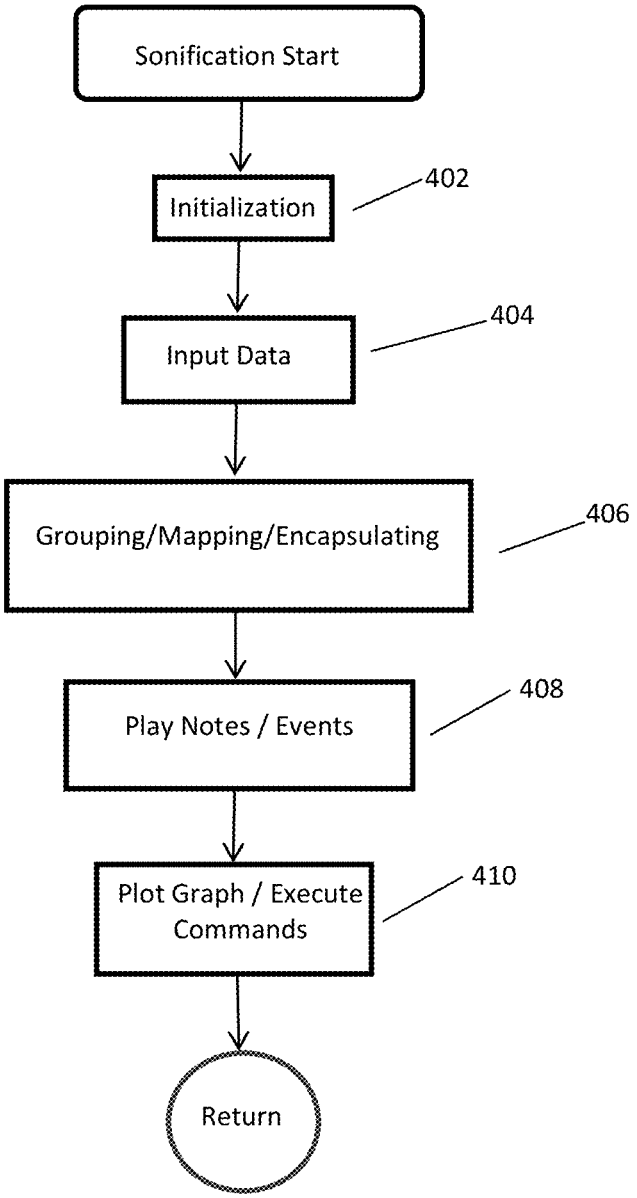
FIG. 4 provides a control-flow diagram that represents one implementation of the sonification and visualization system.

FIG. 4 provides a control-flow diagram that represents one implementation of the sonification and visualization system. In step 402, to begin the sonification and visualization process, the system is first initialized. Configuration data for initialization can be previously stored in a configuration file and loaded directly into the system. Alternatively, the configuration data can be edited or further modified manually or using the GUI as described above. In step 404, the system receives a real-time data stream from a data source and passes data input values from the data stream to the server module for mapping. In step 406, the input data values are grouped according to the rules specified in the configuration data. The grouped data is then mapped by the server module to MIDI notes for generating audio signal. The server module also encodes, within the MIDI data stream, the series name and the x, y coordinates for plotting by the event listener. Other operations, such as pausing the playback, can also be represented in the MIDI data stream and executed by the event listener. In step 408, the musical notes generated in step 406 are played back by the sound module. The sound module also decodes the event data for the event listener to execute. In step 410, the x, y coordinates are plotted on a graph and encapsulated commands are executed by the event listener. This example is for a two-dimensional plot (x, y), but further dimensions could be represented graphically by changing the markers for the plotted points on the graph: for example, by changing the size, color, opacity, or tint of the symbol marker on the x, y graph.

Although the present disclosure has been described in terms of particular embodiments, it is not intended that the disclosure be limited to these embodiments. Modifications within the spirit of the disclosure will be apparent to those skilled in the art. For example, various embodiments disclosed in the current document can be adapted for use with any computer based display, including personal computers, distributed computing systems, programmable consumer electronics, tablet displays, smart phone displays, and so on. Any of many different embodiments of the musical sonification and visualization system and method can be obtained by varying any of many different implementation parameters, including programming language, underlying operating system, data structures, control structures, modular organization, and other such parameters. The foregoing descriptions of specific implementations of the present disclosure are presented for purposes of illustration and description.

It is appreciated that the previous description of the disclosed implementations is provided to enable any person skilled in the art to make or use the present disclosure. Various modifications to these implementations will be readily apparent to those skilled in the art, and the generic principles defined herein can be applied to other implementations without departing from the spirit or scope of the disclosure. Thus, the present disclosure is not intended to be limited to the implementations shown herein but is to be accorded the widest scope consistent with the principles and novel features disclosed herein.

What is claimed is:

1. A method for musical sonification and visualization of data, the method comprising:

receiving grouping rules;

receiving mapping parameters;

receiving at least one set of data comprising data rows, each of said data rows comprising a plurality of data entries;

grouping the data rows into a plurality of groups according to the grouping rules;

mapping the grouped data rows to audible symbols and graphical symbols according to the mapping parameters, such that each group of the plurality of groups has a corresponding one of the audible symbols and a corresponding one of the graphical symbols;

rendering the audible symbols to an audio output; and rendering the graphical symbols to a visual output.

2. The method of claim 1, wherein the audible symbols comprise sound of a recorded or simulated instrument.

3. The method of claim 1, wherein the audible symbols comprise synthesized tones.

4. The method of claim 1, wherein the mapping further comprises determining coordinates of the graphical symbols and the rendering further comprises rendering the coordinates to the visual output.

5. The method of claim 1, further comprising filtering the audible symbols such that there is at least one rendered graphical symbol that does not have a corresponding rendered audible symbol.

6. The method of claim 1, wherein the rendering occurs as the at least one data set is being received.

7. The method of claim 1, wherein the mapping of the audible symbols is linear.

8. The method of claim 1, wherein the mapping of the audible symbols is non-linear.

9. The method of claim 8, wherein the mapping of the audible symbols is logarithmic.

10. The method of claim 1, further comprising:

displaying the visual output; and playing the audio output.

11. The method of claim 10, wherein the displaying comprises displaying the visual output as an animation, and wherein the playing comprises playing the audio output in sync with the visual output.

12. The method of claim 11, further comprising:

receiving display rate data from a user;

adjusting a speed of the displaying and playing based on the display rate data.

13. The method of claim 1, wherein the mapping further comprises encapsulated commands corresponding to the graphical symbols and the rendering the graphical symbols is based in part on the encapsulated commands.

14. The method of claim 1, wherein the grouping includes placing at least one data row in more than one group.

15. A non-transitory computer readable medium coded with data that performs the method of claim 1 when operated on a computer.

16. A device comprising a processor performing, when in operation, the method of claim 1.

17. A musical sonification and visualization system comprising:

one or more processors;

one or more data-storage devices; and computer instructions stored in one or more of the one or more data-storage devices that when executed by one or more of the one or more processors, control the musical sonification and visualization system to receive grouping rules;

receive mapping parameters;

receive at least one set of data comprising data rows, each of said data rows comprising a plurality of data entries;

group the data rows into a plurality of groups according to the grouping rules;

map the grouped data rows to audible symbols and graphical symbols according to the mapping parameters, such that each group of the plurality of groups has a corresponding one of the audible symbols and a corresponding one of the graphical symbols;

render the audible symbols to an audio output; and render the graphical symbols to a visual output.

* * * * *